US008322076B2

(12) United States Patent
Isaacs et al.

(10) Patent No.: US 8,322,076 B2
(45) Date of Patent: Dec. 4, 2012

(54) ADJUSTABLE GLIDE APPARATUS FOR A SLIDING PANEL ASSEMBLY

(75) Inventors: Joseph D. Isaacs, Rice Lake, WI (US); Jeffrey V. Sawyers, Rice Lake, WI (US)

(73) Assignee: Quanex Building Products Corporation, Houston, TX (US)

( * ) Notice: Subject to any disclaimer, the term of this patent is extended or adjusted under 35 U.S.C. 154(b) by 187 days.

(21) Appl. No.: 12/833,249

(22) Filed: Jul. 9, 2010

(65) Prior Publication Data

US 2012/0005964 A1 Jan. 12, 2012

(51) Int. Cl.
*E05D 13/00* (2006.01)

(52) U.S. Cl. ..... 49/452; 49/410; 16/105

(58) Field of Classification Search ..... 49/409, 49/410, 411, 412, 452; 16/87 R, 90, 91, 16/93 R, 97, 99, 105, 106
See application file for complete search history.

(56) References Cited

U.S. PATENT DOCUMENTS

| | | | | |
|---|---|---|---|---|
| 2,990,567 | A * | 7/1961 | Pearson | 16/105 |
| 3,237,238 | A * | 3/1966 | Anderson | 16/105 |
| 4,134,178 | A * | 1/1979 | Stevens | 16/100 |
| 4,850,078 | A | 7/1989 | Libby et al. | |
| 4,868,935 | A * | 9/1989 | Van Weelden | 4/610 |
| 5,280,686 | A * | 1/1994 | Davies | 49/209 |
| 5,488,803 | A * | 2/1996 | George | 49/425 |
| 5,845,363 | A * | 12/1998 | Brempell et al. | 16/105 |
| 6,148,451 | A * | 11/2000 | DeBraal et al. | 4/607 |
| 7,555,871 | B1 * | 7/2009 | Neal | 52/204.51 |
| 2002/0032995 | A1 * | 3/2002 | Siudzinski et al. | 52/207 |
| 2006/0230575 | A1 * | 10/2006 | Quinn et al. | 16/87.2 |
| 2007/0175121 | A1 * | 8/2007 | Speyer et al. | 52/207 |

* cited by examiner

*Primary Examiner* — Katherine W Mitchell
*Assistant Examiner* — Justin Rephann
(74) *Attorney, Agent, or Firm* — Howard & Howard Attorneys PLLC

(57) ABSTRACT

An adjustable glide apparatus is for a sliding panel to slide along a track between open and closed positions. The adjustable glide apparatus comprises a housing defining a cavity with at least one receiver disposed within the cavity. An adjustment stem has an end that has a thread and is disposed within the cavity. A cam is coupled to the receiver for moving the receiver relative to the housing. The cam comprises a plurality of teeth for engaging the thread to rotate the cam as the adjustment stem is rotated thereby moving the receiver relative. A glide is coupled to the receiver and comprises a contact surface. The contact surface is adapted for sliding engagement with the track to slide the sliding panel between the open and the closed positions. A distance between the contact surface and the housing is adjusted as the receiver is moved by the cam.

23 Claims, 6 Drawing Sheets

ADJUSTABLE GLIDE APPARATUS FOR A SLIDING PANEL ASSEMBLY

BACKGROUND OF THE INVENTION

1. Field of the Invention

The invention generally relates to an adjustable glide apparatus and, more specifically, to an adjustable glide apparatus for a sliding panel assembly.

2. Description of the Related Art

Traditional sliding panel assemblies include a panel such as a window or a door that moves between an open and a closed position. Generally, the panel is moved along a track with a guide ridge extending from the track. Typically, the panel includes rollers for rolling the panel between the open and closed positions. The traditional sliding panel assemblies also typically include an adjustable roller apparatus for adjusting a distance between the rollers and the panel. Adjusting the distance between the rollers and the panel spaces the panel from the track to prevent the panel from binding within the track.

The rollers are disposed on opposite sides of the panel for rolling the panel along the guide ridge between the open and closed positions. The rollers have a contact surface presenting a circular configuration that rotatably contacts the guide ridge of the track as the sliding panel is rolled between the open and closed positions. Ideally, the rollers would allow the panel to roll smoothly between the open and closed positions. However, the contact surface of the rollers may be out of round or a portion of the roller may become damaged, which prevents the rollers from rolling smoothly along the track. Additionally, because of their circular shape, the rollers have limited engagement with the guide ridge of the track. Therefore, the rollers may be easily dislodged from the guide ridge resulting in the panel becoming difficult to move. Furthermore, because of the limited engagement between the rollers and the guide ridge, the rollers are impacted by any imperfections in the guide ridge, which prevents the rollers from rolling smoothly along the track. Alternatively, debris may accumulate on the rollers over time and the debris can interfere with the engagement between the contact surface and the guide ridge, which also prevents the rollers from rolling smoothly along the track.

Traditionally, the rollers are formed from a plastic material using a mold. The formation of the rollers with the mold can result in parting lines being formed on the contact surface. Parting lines on the contact surface of the rollers interferes with the engagement between the rollers and the guide ridge, which prevents the rollers from rolling smoothing along the track. Additionally, the plastic material has a tendency to wear out over time. Once the rollers wear out, the panel becomes difficult to move.

SUMMARY OF THE INVENTION AND ADVANTAGES

An adjustable glide apparatus is for a sliding panel to slide along a track between an open and a closed position. The adjustable glide apparatus comprises a housing defining a cavity with at least one receiver disposed within the cavity. An adjustment stem has an end disposed within the cavity with the end having a thread. A cam is rotatably supported within the cavity and coupled to the receiver for moving the receiver relative to the housing. The cam comprises a plurality of teeth disposed about a periphery of the cam for engaging the thread to rotate the cam as the adjustment stem is rotated thereby moving the receiver relative to the housing. A glide is coupled to the receiver and comprises a contact surface. The contact surface is adapted for sliding engagement with the track to slide the sliding panel between the open and the closed positions. A distance between the contact surface and the housing is adjusted as the receiver is moved by the cam.

The glide prevents the sliding panel from becoming easily dislodged from the track. Additionally, the glide allows the sliding panel to slide smoothly along the track without the sliding panel binding even if a portion of the glide becomes damaged.

BRIEF DESCRIPTION OF THE DRAWINGS

Other advantages of the present invention will be readily appreciated, as the same becomes better understood by reference to the following detailed description, when considered in connection with the accompanying drawings wherein.

DETAILED DESCRIPTION OF THE EXEMPLARY EMBODIMENT

Figure 1:
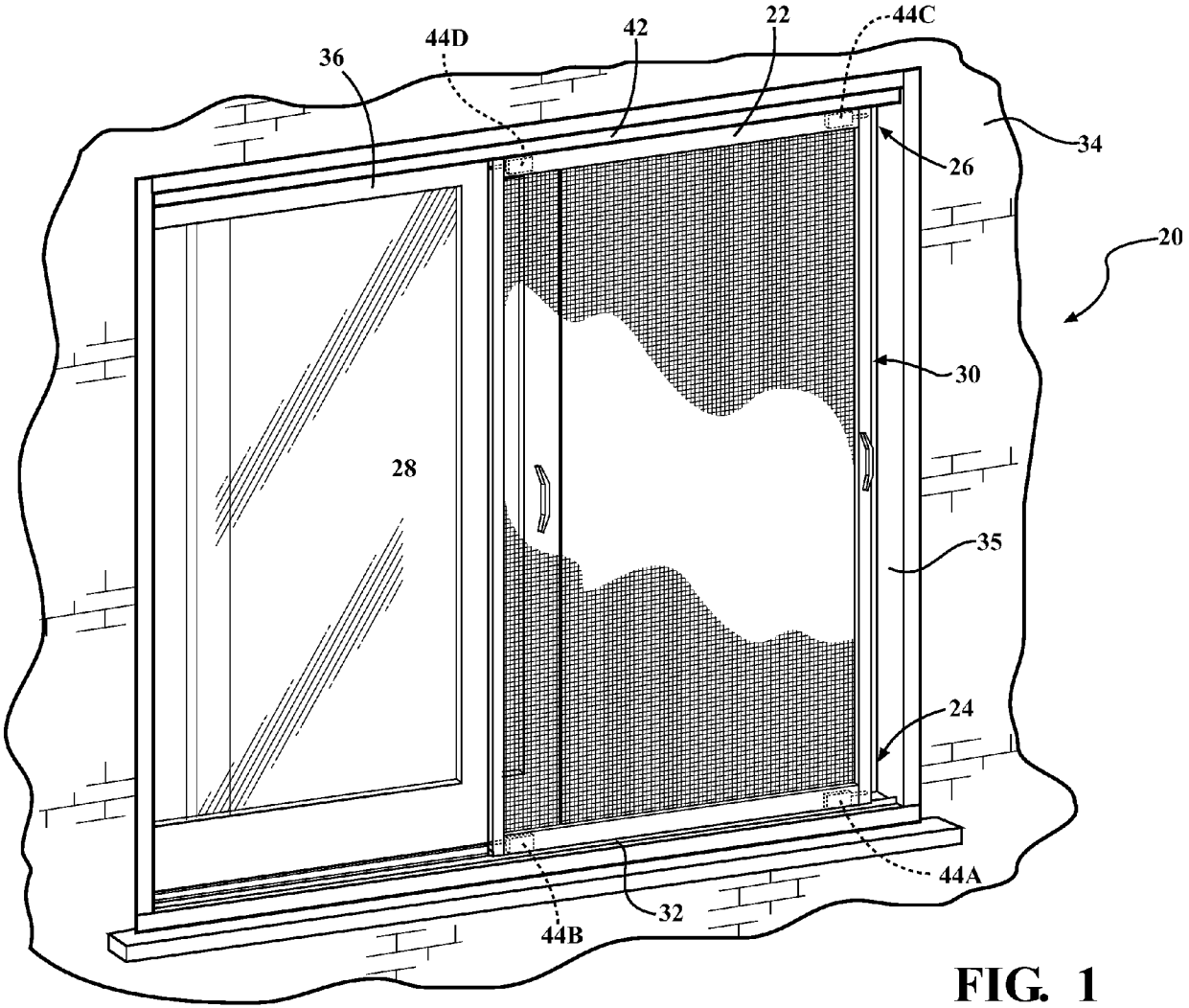
FIG. 1 is a perspective view of a sliding panel assembly.

Referring to the Figures, wherein like numerals indicate corresponding parts throughout the several views, a sliding panel assembly 20 is generally shown. With reference to FIG. 1, the sliding panel assembly 20 comprises a sliding panel 22. The sliding panel 22 may be a fenestration article, such as a window, door, or screen. The sliding panel 22 presents a general rectangular configuration with a bottom rail 24 and a top rail 26 spaced from the bottom rail 24. The sliding panel 22 also has opposing first and second stiles 28, 30 disposed between the bottom and top rails 24, 26. It is to be appreciated that the sliding panel 22 may have other configurations.

The sliding panel assembly 20 operates in conjunction with a track 32. More specifically, the sliding panel 22 of the sliding panel assembly 20 slides along the track 32 between an open and a closed position. Generally, an opening is defined within a structure 34, such as a wall of a building, and the track 32 is mounted within the opening. As shown in FIG. 1, a side jamb 35 may also be mounted within the opening for receiving the second stile 30 when the sliding panel 22 is in the closed position to close the opening. The sliding panel assembly may include a second panel 36 offset from the sliding panel 22 with the panels 22, 36 overlapping each other. The second panel 36 may be fixed or the second panel 36 may slide along the track 32 in a similar manner to the sliding panel 22. When the sliding panel 22 is in the closed position, the sliding panel 22 covers the opening. When the sliding panel 22 is in the open position, the sliding panel 22 only partially covers the opening.

Figure 2:
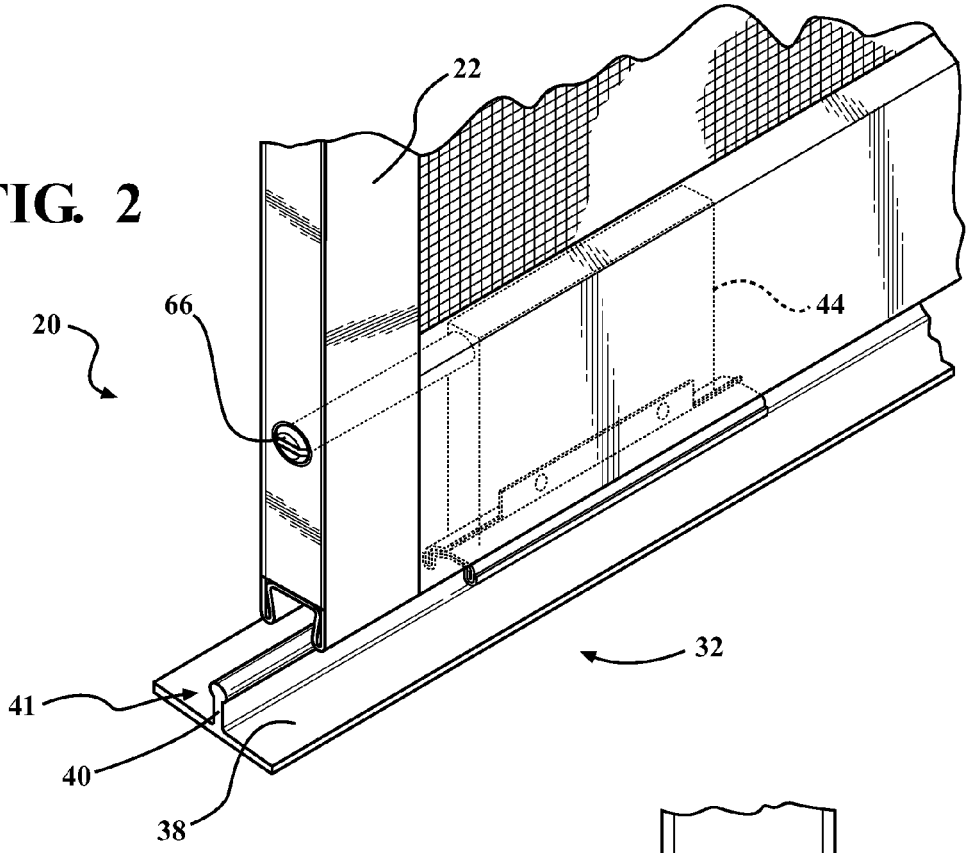
FIG. 2 is a perspective view of a portion of the sliding panel assembly, which includes a panel, and an adjustable glide apparatus coupled to the panel with the glide apparatus in contact with a track.
Figure 3:
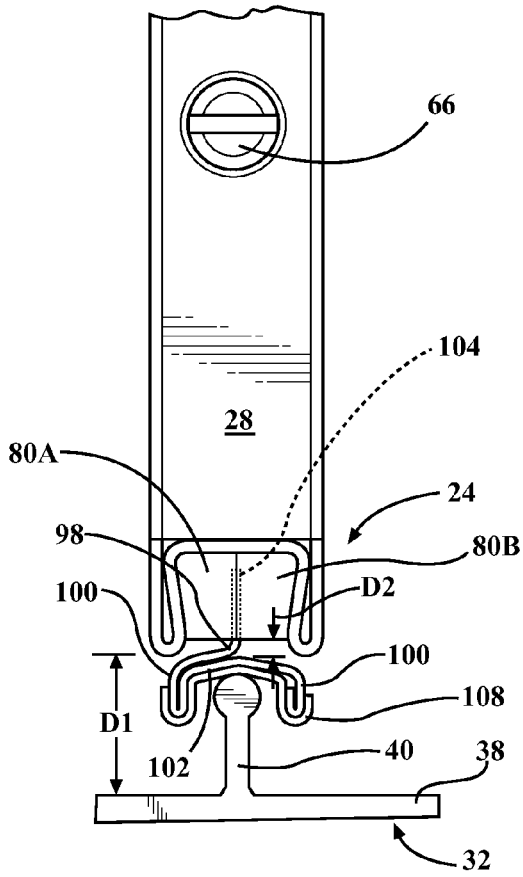
FIG. 3 is a side view of the sliding panel assembly.

With reference to FIGS. 2 and 3, the track 32 includes a bottom plate 38 and a guide ridge 40 extending perpendicularly from the bottom plate 38 of the track 32 to an end 41. Generally, the sliding panel 22 is supported by the guide ridge 40 of the track 32 with the bottom rail 24 of the sliding panel 22 spaced a distance D1 from the bottom plate 38 of the track 32. The guide ridge 40 also guides the sliding panel 22 between the open and closed positions. Although not required, the end 41 of the guide ridge 40 may be bulbous to facilitate the movement of the sliding panel 22 along the track 32 and support the sliding panel 22.

The bottom plate 38 and the guide ridge 40 are preferably formed as a single integral component. However, the guide ridge 40 may be discrete from the bottom plate 38 with the guide ridge 40 coupled to the bottom plate 38 by fasteners, welding, a snap-fit connection, or any other suitable method of coupling. The track 32 may comprise any suitable material including, but not limited to, metals and plastics. For example, the track 32 may comprise aluminum, stainless steel, vinyl, or fiberglass. The track 32 may be formed by any suitable process such as molding, roll forming, and PullTrusion.

With reference to FIG. 1, the sliding panel assembly 20 may also include a second track 42 disposed adjacent the top rail 26 of the sliding panel 22 for guiding the sliding panel 22 between the open and closed positions. The second track 42 may be similar to the track 32 described above and include the guide ridge 40. Alternatively, the second track 42 may be U-shaped in cross-section for receiving a portion of the sliding panel 22 to prevent the sliding panel 22 from rotating out of the opening.

With reference to FIGS. 4 through 7, the sliding panel assembly 20 includes at least one adjustable glide apparatus 44 for contacting the guide ridge 40 of the track 32. The adjustable glide apparatus 44 allows the distance D1 between the bottom rail 24 of the sliding panel 22 and the bottom plate 38 of the track 32 to be adjusted. Adjusting the distance D1 ensures there is adequate clearance between the bottom rail 24 of the sliding panel 22 and the track 32 to prevent the sliding panel 22 from binding within the track 32. Therefore, the sliding panel 22 may be used with different tracks other than the track 32 described above while still providing clearance between the sliding panel 22 and the track 32. For example, the sliding panel 22 may be used with an existing track as a replacement for a broken sliding panel. Additionally, the distance D1 can be adjusted to make the stile 30 perpendicular to the track 32 for allowing the stile 30 to mate with the side jamb 35 along an entire height of the stile 30. Said differently, adjusting the distance D1 can square the sliding panel 22 within the opening.

The at least one adjustable glide apparatus 44 may be further defined as a first adjustable glide apparatus 44A and a second adjustable glide apparatus 44B. The first and second adjustable glide apparatuses 44A, 44B are typically disposed within the bottom rail 24 for contacting the guide ridge 40 of the track 32 to guide the sliding panel 22 between the opened closed positions. The at least one adjustable glide apparatus 44 may also be defined as a third adjustable glide apparatus 44C and a fourth adjustable glide apparatus 44D. The third and fourth adjustable glide apparatuses 44C, 44D are typically disposed within the top rail 26 for contacting the guide ridge 40 of the second track 42 to guide the sliding panel 22 between the opened closed positions. Alternatively, the sliding panel assembly 20 may include rollers disposed along the top rail 26 to contact the second track 42 and guide the sliding panel 22 between the open and closed positions. It is to be appreciated that any combination of the adjustable glide apparatuses 44A-44D may be used and the adjustable glide apparatuses 44A-44D do not have to be used in pairs. For example, the sliding panel assembly 20 may include only one of the adjustable glide apparatuses 44A-44D.

The sliding panel 22 defines at least one pocket 46 for receiving the adjustable glide apparatus 44. Said differently, the adjustable glide apparatus 44 is disposed in the pocket 46 of the sliding panel 22. Generally, the pocket 46 is defined by the sliding panel 22. More specifically, the pocket 46 is defined by either of the rails 24, 26 proximate one of the first and second stiles 28, 30 of the sliding panel 22. For example, when either of the first and second adjustable glide apparatuses 44A, 44B are present, the bottom rail 24 defines the pocket 46 for each of the first and second adjustable glide apparatuses 44A, 44B. When the third and fourth adjustable glide apparatuses 44C, 44D are present, the top rail 26 defines the pocket for each of the third and fourth adjustable glide apparatuses 44C, 44D. It is to be appreciated that when only one of the adjustable glide apparatuses 44A-44D is used, the pocket 46 is typically defined by the bottom rail 24 adjacent the second stile 30.

Figure 6:
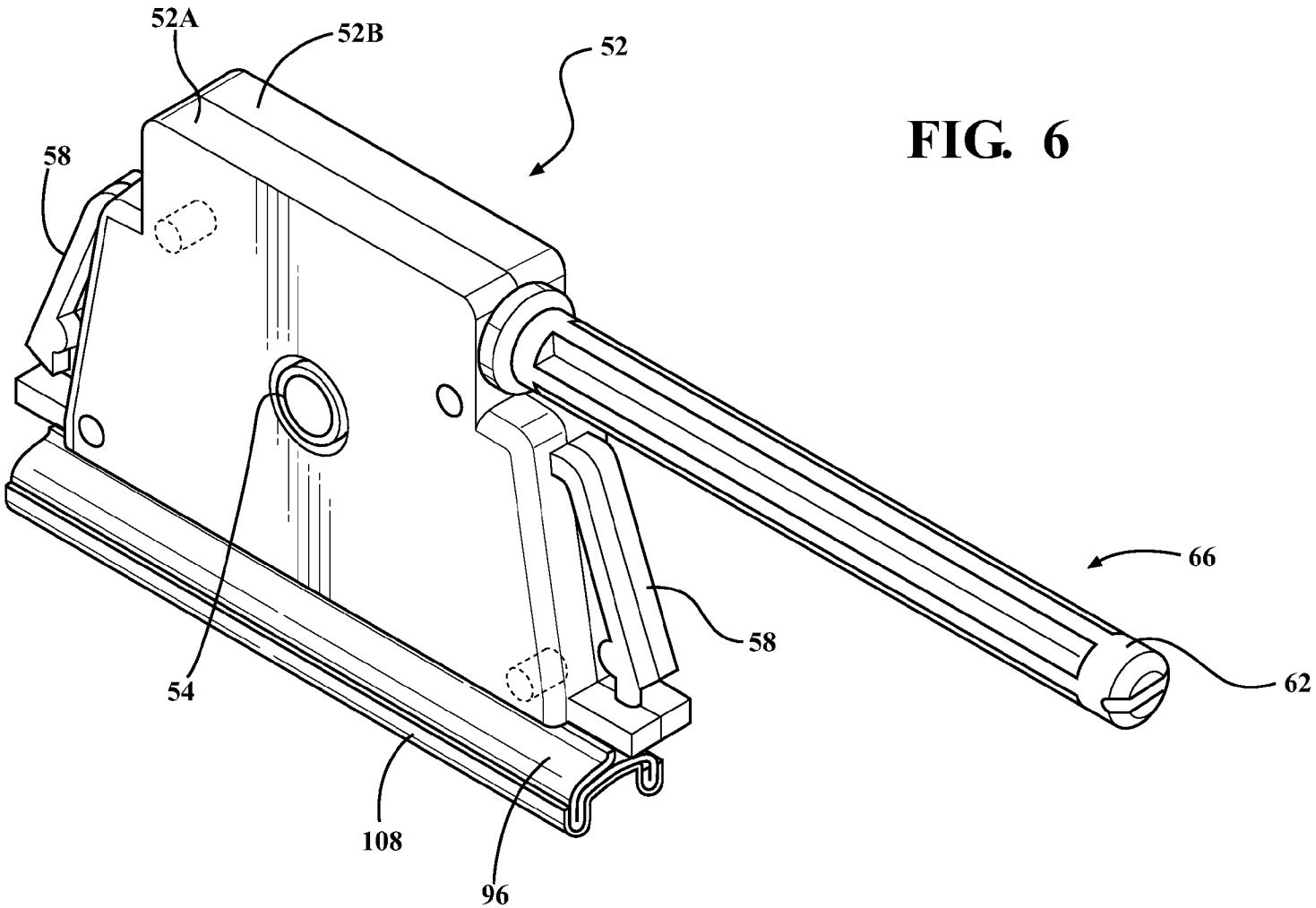
FIG. 6 is a perspective view of the adjustable glide apparatus.
Figure 7:
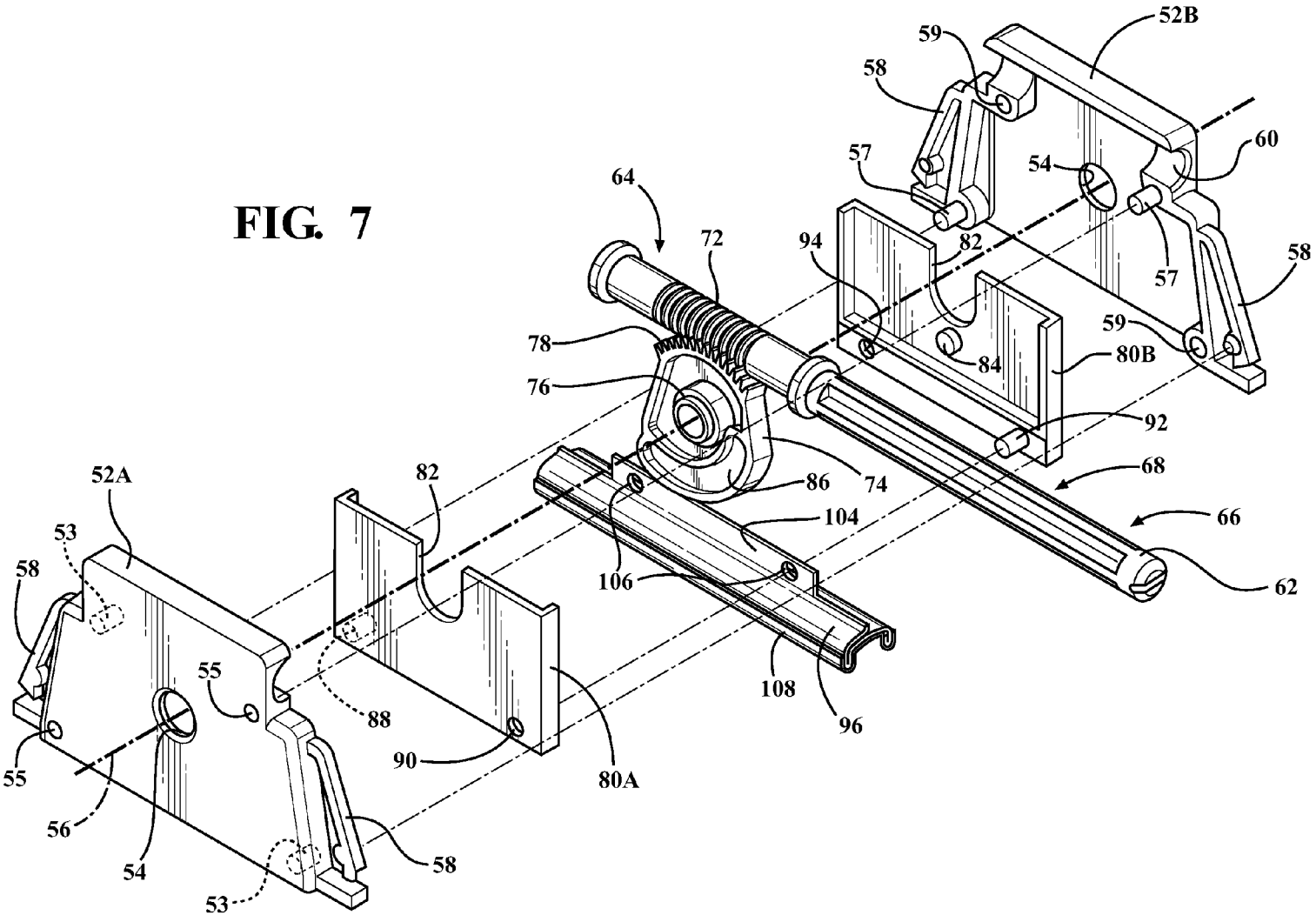
FIG. 7 is an exploded view of the adjustable glide apparatus.

With particular reference to FIGS. 6 and 7, the adjustable glide apparatus 44 comprises a housing 52 defining a cavity. The housing 52 may have a first half 52A and a second half 52B configured to mate with the first half 52A thereby defining the cavity between the first half 52A and the second half 52B. As shown in the Figures, the first half 52A includes a first pair of fingers 53 and defines a first pair of voids 55. The second half 52B includes a second pair of fingers 57 and defines a second pair of voids 59. The fingers 53, 57 mate with the voids 55, 59 to couple the first half 52A to the second half 52B. Said differently, the first pair of fingers 53 of the first half 52A are pressed into the second pair of voids 59 of the second half 52B and the second pair of fingers 57 of the second half 52B are pressed into the first pair of voids 55 of the first half 52A. It is to be appreciated that the first half 52A and the second half 52B may be secured together by any suitable method including, but not limited to, ultrasonic welding.

The housing 52 may define a pair of support holes 54. Each of the halves 52A, 52B of the housing 52 may define one of the support holes 54. The support holes 54 are aligned with each other thereby defining an axis 56 through a center point of the support holes 54. The housing 52 may include a pair of arms 58 extending from the housing 52 for engaging the interior wall of the sliding panel 22 to secure the housing 52 within the pocket 46. The housing 52 also defines an access hole 60 for allowing access to the cavity.

Figure 4:
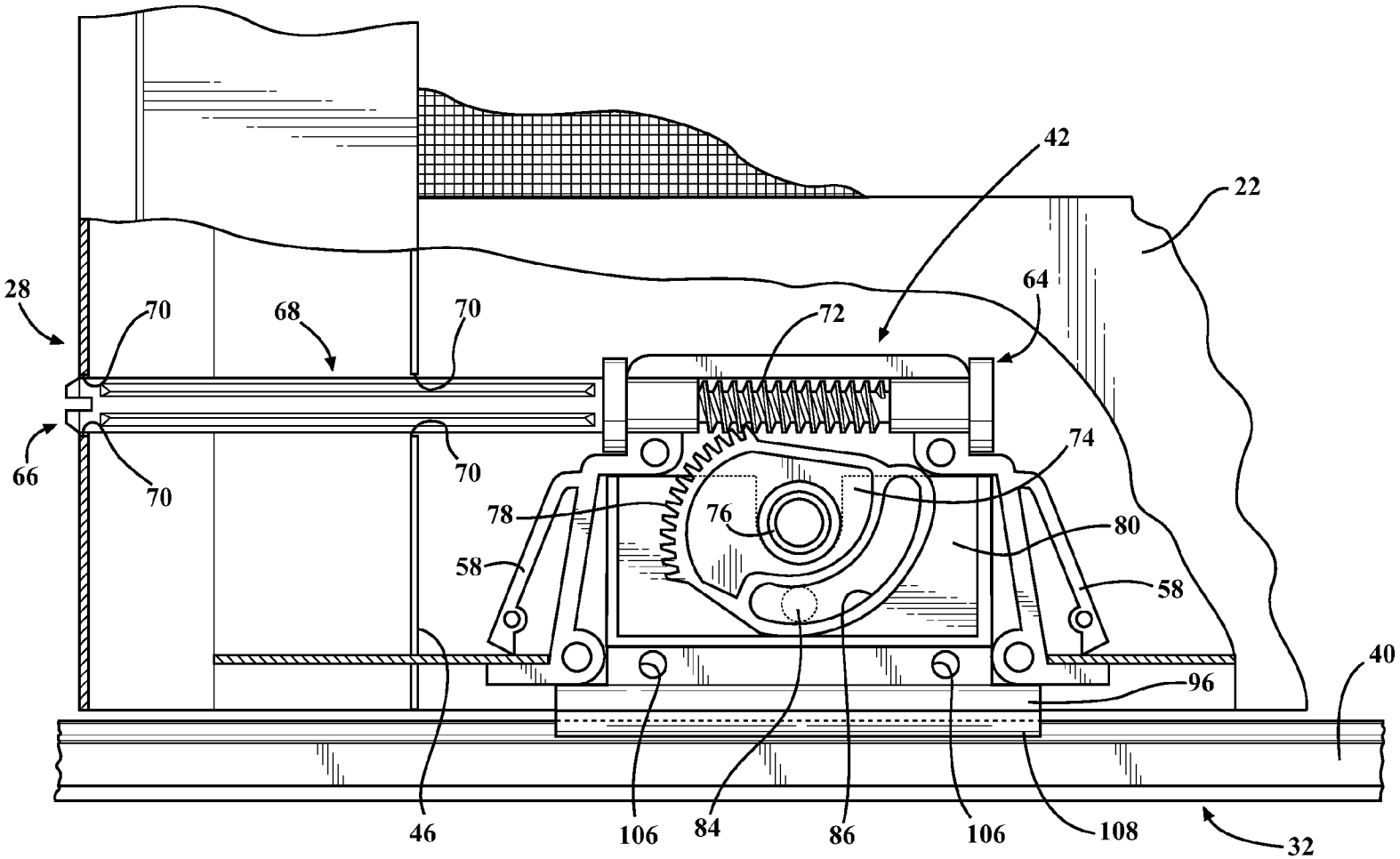
FIG. 4 is a front view of a portion of the sliding panel assembly with a portion of the panel cut away to expose the adjustable glide apparatus in a first position.
Figure 5:
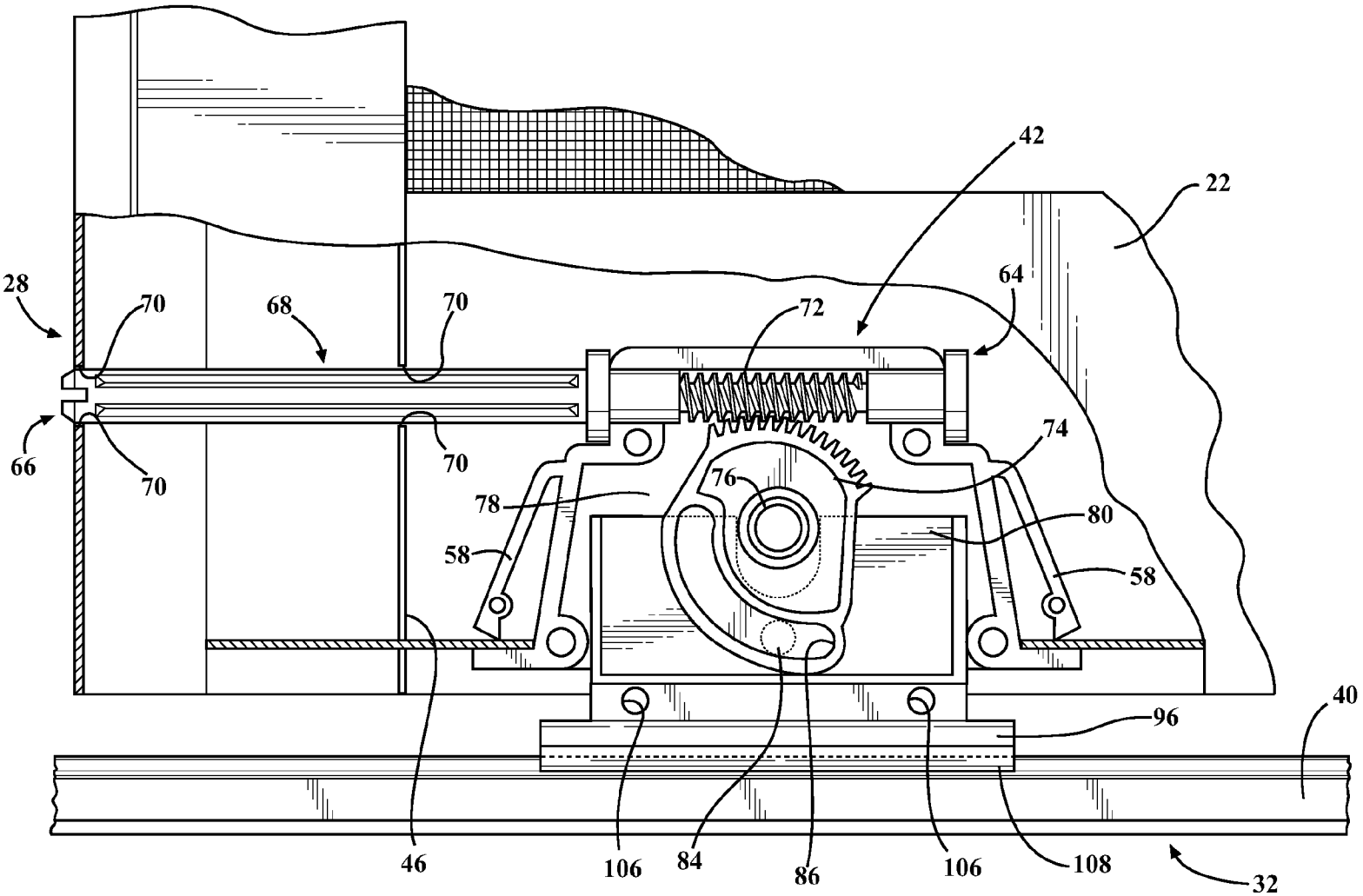
FIG. 5 is a front view of a portion of the sliding panel assembly with a portion of the panel cut away to expose the adjustable glide apparatus in a second position.

An adjustment stem 62 is disposed within the cavity of the housing 52. The adjustment stem 62 has a first end 64 disposed within the cavity and a second end 66 extending from the housing 52 with a body portion 68 disposed between the first and second ends 64, 66. The body portion 68 of the adjustment stem 62 extends through the access hole 60 of the housing 52 with the adjustment stem 62 free to rotate within the cavity. With reference to FIGS. 4 and 5, the sliding panel 22 defines a bore 70 extending from one of the first and second stiles 28, 30 of the sliding panel 22 to the interior wall defining the pocket 46. Said differently, the bore 70 allows access to the pocket 46 through one of the first and second stiles 28, 30 of the sliding panel 22. The second end 66 of the adjustment stem 62 extends through the bore 70 to allow access to the second end 66 of the adjustment stem 62. Having access to the second end 66 of the adjustment stem 62 allows the adjustment stem 62 to be rotated once the adjustable glide apparatus 44 is disposed within the pocket 46. The first end 64 of the adjustment stem 62 within the cavity has a thread 72. Said differently, the first end 64 of the adjustment stem 62 is threaded.

The adjustable glide apparatus 44 comprises a cam 74 rotatably supported within the cavity of the housing 52. The cam 74 may include support bosses 76 for mating with the support holes 54 of the housing 52 to secure the cam 74 within the cavity of the housing 52. The mating of the support bosses 76 with the support holes 54 allows the cam 74 to rotate about the axis 56.

The cam 74 comprises a plurality of teeth 78 disposed about a periphery of the cam 74. The teeth 78 of the cam 74 are for engaging the thread 72 of the adjustment stem 62 to rotate the cam 74 as the adjustment stem 62 is rotated. It is to be appreciated that the adjustment stem 62 may rotate the cam 74 without the use of the thread 72 and the teeth 78 so long as rotation of the adjustment stem 62 is translated into rotation of the cam 74.

The adjustable glide apparatus 44 also comprises at least one receiver 80 disposed within the cavity of the housing 52. The cam 74 is coupled to the receiver 80 for moving the receiver 80 relative to the housing 52 as the cam 74 is rotated. The receiver 80 has a first position wherein the receiver 80 is fully within the cavity of the housing 52, as shown in FIG. 4. The receiver 80 has a second position wherein the receiver 80 extends from the housing 52, as shown in FIG. 5. The receiver 80 may define a notch 82 for allowing the receiver 80 to move freely between the first and second positions. For example, the notch 82 allows the receiver 80 to move between the first and second positions without interference from the support boss of the cam 74.

The receiver 80 may comprise a post 84 extending from the receiver 80. If the receiver 80 comprises a post 84, the cam 74 may define a slot 86 presenting a spiral configuration. Said differently, the slot 86 of the cam 74 defines a centerline and the centerline of the slot 86 is progressively spaced from the axis 56 that the cam 74 rotates about. The post 84 of the receiver 80 is disposed within the slot 86. The post 84 slides along the slot 86 as the cam 74 rotates to move the receiver 80 relative to the housing 52 between the first and second positions. Said differently, the post 84 is in sliding engagement with the slot 86. The sliding of the post 84 along the slot 86 adjusts (i.e., increases or decreases) a spacing between the post 84 and the axis 56 thereby moving the receiver 80 between the first and second positions. Because the slot 86 has a spiral configuration, the receiver 80 moves from the first position toward the second position as the post 84 slides along the slot 86 when the adjustment stem 62 is rotated in a clockwise direction. Alternatively, when the adjustment stem 62 is rotated in a counterclockwise direction, the post 84 slides along the slot 86 thereby moving the receiver 80 from the second position toward the first position.

The at least one receiver 80 may be further defined as a first receiver 80A and a second receiver 80B coupled to the first receiver 80A. The first receiver 80A includes a first boss 88 and defines a first orifice 90. The second receiver 80B includes a second boss 92 and defines a second orifice 94. The bosses 88, 92 mate with the orifices 90, 94 to couple the first and second receivers 80A, 80B together. Said differently, the first boss 88 of the first receiver 80A is pressed into the second orifice 94 of the second receiver 80B and the second boss 92 of the second receiver 80B is pressed into the first orifice 90 of the first receiver 80A to couple the first and second receivers 80A, 80B together.

The adjustable glide apparatus 44 comprises a glide 96 coupled to the receiver 80. Preferably, the glide 96 is adapted for sliding along the guide ridge 40 as the sliding panel 22 moves between the open and closed positions. With reference to FIG. 3, the glide 96 may include a base 98 and a pair of legs 100 extending from the base 98 to respective ends. The legs 100 are spaced from each other. The base 98 and the legs 100 may present a U-shaped cross-section. However, it is to be appreciated that the base 98 and legs 100 may present other cross-sections, such as C-shaped or V-shaped.

The glide 96 comprises a contact surface 102 adapted for sliding engagement with the track 32 to slide the sliding panel 22 between the open and the closed positions. The glide 96 allows the sliding panel 22 to move smoothly between the open and the closed positions. The contact surface 102 may be defined by the base 98 and the legs 100. At least a portion of the contact surface 102 of the glide 96 contacts the guide ridge 40 with the guide ridge 40 supporting the sliding panel 22 via the adjustable glide apparatus 44. Although not required, the contact surface 102 is disposed about the guide ridge 40 such that the base 98 and the legs 100 guide the sliding panel 22 along the guide ridge 40 between the open and closed positions.

The contact surface 102 of the glide 96 typically has an entire length of at least 1.0, and more typically about 2.5 inches. However, the entire length of the contact surface 102 of the glide 96 may extend for an entire width of the sliding panel 22. As illustrated in FIGS. 4 and 5, the contact surface 102 of the glide 96 extends linearly relative to the receiver 80 such that said contact surface 102 is parallel to the track 32 as the sliding panel 22 is slid along the track 32 between the open and the closed positions. Said differently, the contact surface 102 extends in a parallel direction to the guide ridge 40 for the entire length of the contact surface 102 such that the entire contact surface 102 is parallel with the track 32. Because the contact surface 102 extends in a parallel direction to the guide ridge 40, the sliding panel 22 can still slide smoothly along the track 32, without binding, if a portion of the glide 96 becomes damaged.

Although not required, the contact surface 102 may contact the guide ridge 40 of the track 32 over the entire length of the contact surface 102. Typically, the contact surface 102 contacts the track 32 over an engagement length of at least 1.0, and more typically of from about 2.5 to 5.0 inches. It is to be appreciated that the engagement length may be the entire length of the contact surface 102. The engagement of the contact surface 102 with the guide ridge 40 over the engagement length allows the contact surface 102 to span any imperfections in the guide ridge 40 to ensure the glide 96 slides smoothly along the track 32. Additionally, the engagement of the contact surface 102 with the guide ridge 40 over the engagement length prevents the build up of debris on the contact surface 102, which also ensures the glide 96 slides smoothly along the track 32. Furthermore, the engagement of the contact surface 102 with the guide ridge 40 over the engagement length prevents the glide 96 from becoming dislodged from the guide ridge 40 of the track 32, which ensures the glide 96 slides smoothly along the track 32.

With particular reference to FIG. 7, the glide 96 may comprise a flange 104 extending toward the receiver 80 for coupling the glide 96 to the receiver 80. The flange 104 may define a pair of fastening holes 106 with the bosses 88, 92 of the receivers 80A, 80B mating with the fastening holes 106 of the flange 104 to couple the glide 96 to the receiver 80. Coupling the glide 96 to the receiver 80 prevents the glide 96 from rotating as the sliding panel 22 is moved between the open and closed positions. Said differently, coupling the glide 96 to the receiver 80 prevents rotation of the contact surface 102 of the glide 96 relative to the housing 52 as the sliding panel 22 is moved. Additionally, coupling the glide 96 to the receiver 80 allows the glide 96 to move with the receiver 80 as the receiver 80 moved between the first and second positions when the cam 74 is rotated. A distance D2 between the contact surface 102 and the housing 52 is adjusted as the receiver 80 is moved by the cam 74. Adjusting the distance D2 between the contact surface 102 and the housing 52 also adjusts the distance D1 between the sliding panel 22 and the track 32. Additionally, the distance D2 between the contact surface 102 and the housing 52 is adjusted for allowing the sliding panel 22 to be placed on the guide ridge 40. Said differently, the glide 96 is moved toward the bottom rail 24 of the sliding panel 22 to facilitate placement of the sliding panel 22 on the guide ridge 40. Once the sliding panel 22 is placed on the guide ridge 40, the glide 96 is moved away from the bottom rail 24 of the sliding panel 22 to provide adequate spacing between the bottom rail 24 of the sliding panel 22 and the bottom plate 38 of the track 32.

The glide 96 may comprise any suitable material. For example, the glide 96 may comprise a metal, such as steel or aluminum. Alternatively, the glide 96 may comprise a thermoplastic material. Typically, the glide 96 is roll formed from the metal. However, the glide 96 may be formed by any suitable process using any suitable material.

To facilitate sliding movement of the glide 96 along the guide ridge 40, a layer of polymeric material 108 may be secured to the contact surface 102 of the glide 96. The layer of polymeric material 108 reduces friction between the glide 96 and the track 32. The layer of polymeric material 108 may be extruded onto the contact surface 102 of the glide 96 using an extrusion process. Said differently, the layer of polymeric material 108 may be extruded onto the base 98 and the legs 100 of the glide 96. The layer of polymeric material 108 can be extruded in conjunction with roll forming of the glide 96. An example of a process which extrudes the layer of polymeric material 108 in conjunction with roll forming of the glide 96 is known as RollTrusion®. However, the application of the polymeric material onto the contact surface 102 of the glide 96 is not limited to being extruded in conjunction with the roll forming process and may include any suitable application process. It is to be appreciated that the layer of polymeric material 108 may also be secured to the guide ridge 40 of the track 32. Additionally, when the layer of polymeric material 108 is secured to the contact surface 102 of the glide 96, a second layer of polymeric material may be secured to the guide ridge 40 of the track 32 with the first layer of polymeric material 108 sliding along the second layer of polymeric material to further reduce friction between the glide 96 and the track 32.

The layer of polymeric material 108 may comprise a thermoplastic. Examples of suitable thermoplastics include polyvinyl chloride (PVC) and polyamides. Examples of suitable polyamides include nylons, such as nylon-6, nylon-6,6, and combinations thereof. Although not required, the polyamide may include homopolymers, copolymers, and combinations thereof. It is to be appreciated that the polymeric material is not limited to PVC or polyamides and may include any suitable type of polymeric material that facilitates sliding movement of the glide 96 along the guide ridge 40.

If the glide 96 comprises the metal, an adhesive may be disposed between the layer of polymeric material 108 and the contact surface 102 of the metal glide 96 for adhesively securing the layer of polymeric material 108 to the metal glide 96. The adhesive acts as a tie-layer to secure the layer of polymeric material 108 to the contact surface 102 of the metal glide 96. The adhesive is applied between the glide 96 and the layer of polymeric material 108 during the RollTrusion® process. Said differently, as the layer of polymeric material 108 is being extruded, the adhesive is extruded such that it is between the contact surface 102 of the glide 96 and the layer of polymeric material 108. However, the method of applying the adhesive to the glide 96 is not limited to extrusion and may be secured by any acceptable method.

If present, the adhesive may comprise a thermoplastic elastomer (TPE). An example of a suitable thermoplastic elastomer includes thermoplastic vulcanizates (TPV). Examples of suitable TPVs are commercially available from Advanced Elastomer Systems, of Akron, Ohio, under their line of Santoprene® TPVs. It is to be understood that the TPV is a TPE having a rubber-like phase that is chemically cross-linked. Although not required, the TPV is typically produced by a dynamic vulcanization process where a thermoplastic polymer is melt mixed with a suitable reactive, rubber-like polymer. As alluded to above, the adhesive, preferably the TPV, functions as a tie-layer to adhesively bond the layer of polymeric material 108 to the contact surface 102 of the glide 96.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An adjustable glide apparatus for a sliding panel slidable along a track between an open and a closed position, said apparatus comprising:

a housing defining a cavity;

at least one receiver disposed within said cavity;

an adjustment stem having an end disposed within said cavity with said end having a thread;

a cam rotatably supported within said cavity and coupled to said receiver for moving said receiver relative to said housing with said cam comprising a plurality of teeth disposed about a periphery of said cam for engaging said thread to rotate said cam as said adjustment stem is rotated thereby moving said receiver relative to said housing; and a glide coupled to said receiver and comprising a contact surface which is adapted for sliding engagement with the track to slide the sliding panel between the open and the closed positions, wherein a distance between said contact surface and said housing is adjusted as said receiver is moved by said cam;

wherein said receiver prevents rotation of said contact surface of said glide relative to said housing; and wherein said glide comprises a flange extending toward said receiver and defining a pair of fastening holes and said receiver has a pair of bosses for mating with said fastening holes to couple said glide to said receiver thereby preventing rotation of said glide.

2. An apparatus as set forth in claim 1 further comprising a layer of polymeric material secured to said contact surface of said glide for facilitating sliding movement of said glide along the track.

3. An apparatus as set forth in claim 2 wherein said layer of polymeric material comprises a polyamide.

4. An apparatus as set forth in claim 2 wherein said layer of polymeric material comprises a nylon.

5. An apparatus as set forth in claim 2 wherein said layer of polymeric material comprises a thermoplastic material.

6. An apparatus as set forth in claim 2 wherein said glide comprises a metal and further comprising an adhesive disposed between said layer of polymeric material and said contact surface of said metal glide for adhesively securing said layer of polymeric material to said metal glide.

7. An apparatus as set forth in claim 6 wherein said adhesive comprises a thermoplastic elastomer.

8. An apparatus as set forth in claim 6 wherein said adhesive comprises a thermoplastic vulcanizate.

9. An apparatus as set forth in claim 1 wherein said cam defines a slot presenting a spiral configuration, and said receiver comprises a post disposed within said slot, wherein said post slides along said slot as said cam rotates to move said receiver relative to said housing.

10. An apparatus as set forth in claim 1 wherein said contact surface of said glide extends linearly relative to said receiver such that said contact surface is parallel to the track as the sliding panel is slid along the track between the open and the closed positions.

11. An apparatus as set forth in claim 1 wherein said at least one receiver is further defined as a first receiver having one of said bosses and defining a first orifice and a second receiver having another one of said bosses and defining a second orifice with said bosses extending through said fastening holes of said flange for coupling said flange between said receivers.

12. A sliding panel assembly comprising:

(A) a sliding panel defining a pocket, wherein said sliding panel is for sliding along a track between an open and a closed position; and (B) an adjustable glide apparatus disposed in said pocket and comprising:

a housing defining a cavity;

at least one receiver disposed within said cavity;

an adjustment stem having an end disposed within said cavity with said end having a thread;

a cam rotatably supported within said cavity and coupled to said receiver for moving said receiver relative to said housing with said cam comprising a plurality of teeth disposed about a periphery of said cam for engaging said thread to rotate said cam as said adjustment stem is rotated thereby moving said receiver relative to said housing; and a glide coupled to said receiver and comprising a contact surface which is adapted for sliding engagement with the track to slide the sliding panel between the open and the closed positions, wherein a distance between said contact surface and said housing is adjusted as said receiver is moved by said cam thereby adjusting a distance between said sliding panel and the track;

wherein said receiver prevents rotation of said contact surface of said glide relative to said housing; and wherein said glide comprises a flange extending toward said receiver and defining a pair of fastening holes and said receiver has a pair of bosses for mating with said fastening holes to couple said glide to said receiver thereby preventing rotation of said glide.

13. An assembly as set forth in claim 12 further comprising a layer of polymeric material secured to said contact surface of said glide for facilitating sliding movement of said glide along the track.

14. An assembly as set forth in claim 13 wherein said layer of polymeric material comprises a polyamide.

15. An assembly as set forth in claim 13 wherein said layer of polymeric material comprises a nylon.

16. An assembly as set forth in claim 13 wherein said layer of polymeric material comprises a thermoplastic material.

17. An assembly as set forth in claim 13 wherein said glide comprises a metal and further comprising an adhesive disposed between said layer of polymeric material and said contact surface of said metal glide for adhesively securing said layer of polymeric material to said metal glide.

18. An assembly as set forth in claim 17 wherein said adhesive comprises a thermoplastic elastomer.

19. An assembly as set forth in claim 17 wherein said adhesive comprises a thermoplastic vulcanizate.

20. An assembly as set forth in claim 12 wherein said contact surface of said glide extends linearly relative to said receiver such that said contact surface is parallel to the track as the sliding panel is slid along the track between the open and the closed positions.

21. An assembly as set forth in claim 12 wherein said cam defines a slot presenting a spiral configuration, and said receiver comprises a post disposed within said slot, wherein said post slides along said slot as said cam rotates to move said receiver relative to said housing.

22. An assembly as set forth in claim 12 wherein said contact surface of said glide extends linearly relative to said receiver for extending parallel along the track.

23. An assembly as set forth in claim 12 wherein said at least one receiver is further defined as a first receiver having one of said bosses and defining a first orifice and a second receiver having another one of said bosses and defining a second orifice with said bosses extending through said fastening holes of said flange for coupling said flange between said receivers.

* * * * *